US005589673A

United States Patent [19]

Lehmann et al.

[11] Patent Number: 5,589,673

[45] Date of Patent: Dec. 31, 1996

[54] ELECTRIC HIGH-TENSION CIRCUIT BREAKER

[75] Inventors: Volker Lehmann; Heiner Marin; Ingolf Reiher, all of Berlin, Germany

[73] Assignee: Siemens Aktiengesellschaft, München, Germany

[21] Appl. No.: 313,086

[22] PCT Filed: Feb. 9, 1993

[86] PCT No.: PCT/DE93/00129

§ 371 Date: May 15, 1995

§ 102(e) Date: May 15, 1995

[87] PCT Pub. No.: WO93/20573

PCT Pub. Date: Oct. 14, 1993

[30] Foreign Application Priority Data

Mar. 31, 1992 [DE] Germany ..... 42 11 159.5

[51] Int. Cl.[6] ..... H01H 33/86

[52] U.S. Cl. ..... 218/66; 218/60

[58] Field of Search ..... 218/43, 46, 47, 218/51, 52, 53, 54, 57, 59–64, 66, 68, 72, 73, 76, 86, 88

[56] References Cited

U.S. PATENT DOCUMENTS 4,426,561 1/1984 Berkebile ..... 200/148 A
4,992,634 2/1991 Thuries et al. ..... 200/148 R

FOREIGN PATENT DOCUMENTS 0456139 11/1991 European Pat. Off. ..... H01H 33/91
3720816 1/1989 Germany ..... H01H 33/915

*Primary Examiner*—Brian W. Brown
*Assistant Examiner*—Michael A. Friedhofer
*Attorney, Agent, or Firm*—Kenyon & Kenyon

[57] ABSTRACT

A self-blow-out switch having a compression device has a pressure chamber heated by electric arc energy connected to a compression space, optionally with valve control. The compression space is connected to a low-pressure space via a pressure relief valve and a refill valve. Two valve disks of the relief and refill valves, which are located between the compression space and the low-pressure space are designed as two concentric washers of different diameters, lying in direct contact with each other and partly overlapping each other, and integrated to form a single valve unit.

10 Claims, 1 Drawing Sheet

ELECTRIC HIGH-TENSION CIRCUIT BREAKER

BACKGROUND OF THE INVENTION

The present invention concerns a high-tension circuit breaker with self blow-out and a compression device for blowout of arcs, in which one of the pressure chambers heatable by the arc energy, adjacent to the separating gap is connected to a compression space of the compression device, optionally with valve control, and in which the compression space is connected to a low-pressure space via a pressure relief valve with a movable valve disk on the one hand and a refill valve with a movable valve disk on the other.

In such high-tension circuit breakers, as known from German Published Application 37 20 816, a plurality of valves is provided for controlling the flow and pressure conditions in the circuit breaker, to be used at different points of the compression device and require relatively complex assembly.

SUMMARY OF THE INVENTION

The present invention facilitates assembly for the valve control in a high-tension circuit breaker.

According to the present invention, two valve disks of valves located between a compression space and a low-pressure space are designed as two concentric washers with different diameters in contact with one another with partial overlapping and combining them into a single valve device.

The use of the present invention substantially facilitates the assembly of the individual valve device for refilling and reducing an overpressure.

In a preferred embodiment of the present invention, the first washer with the smaller diameter, acting as a valve seat, is pressed with a spring load against a fixed-position stop on the low-pressure side and raised at a predefined overpressure in the compression space from the valve seat. The inner opening edge of the other washer having the greater diameter is in tight contact with the first washer, acting as a flap valve, and its outer edge is in tight contact with a fixed-position stop acting as a valve seat so that, when the compression device moves in the switch-on direction, this second washer frees the passage section between the compression space and the low-pressure space for refilling the compression space.

The spring load of the first washer is advantageously adjustable. The two washers can, in an advantageous embodiment of the high-tension circuit breaker of the invention, surround a switching rod that traverses the compression space and the low-pressure space, and moves the compression device.

BRIEF DESCRIPTION OF THE DRAWINGS

An embodiment of a high-tension circuit breaker of the invention is described and its operation explained using the drawings.

DETAILED DESCRIPTION

Figure 1:
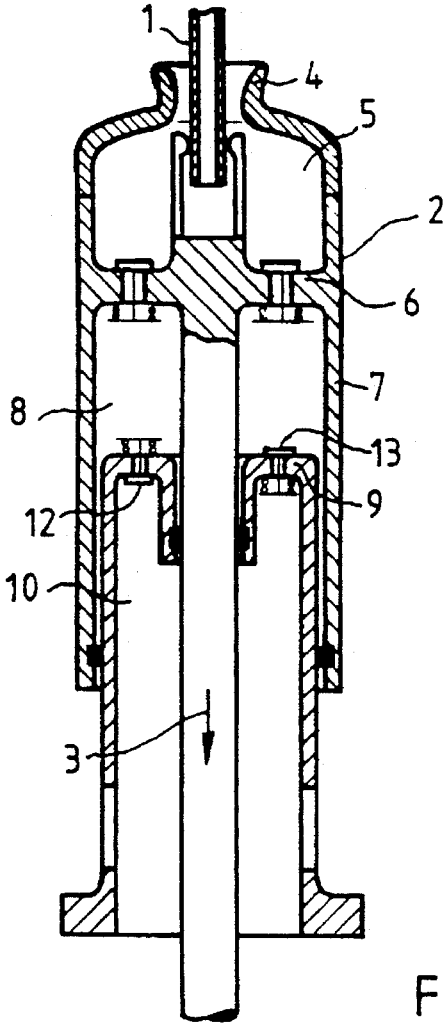
FIG. 1 is a schematic representation of a high-tension circuit breaker in accordance with an embodiment of the present invention.

The high-tension circuit breaker schematically illustrated in FIG. 1 has a fixed-position switching component 1, engaged with a movable switching component 2. In order to separate the two components, switching component 2 is moved in the direction of arrow 3. A pressure chamber 5 formed by a nozzle 4 for conducting the quenching gas stream is rigidly moved together with the movable switching component; the pressure chamber is delimited by bottom 6, rigidly connected with switching component 2. A movable component of the compression device and cylinder 7 illustrated in FIG. 1 delimit a compression space 8 together with a piston bottom 9, which is fixed-position and delimits a low-pressure space 10 from a compression space 8. Fixed-position piston bottom 9 has passage openings for a pressure relief valve on one side and a refill valve on the other side.

Figure 2:
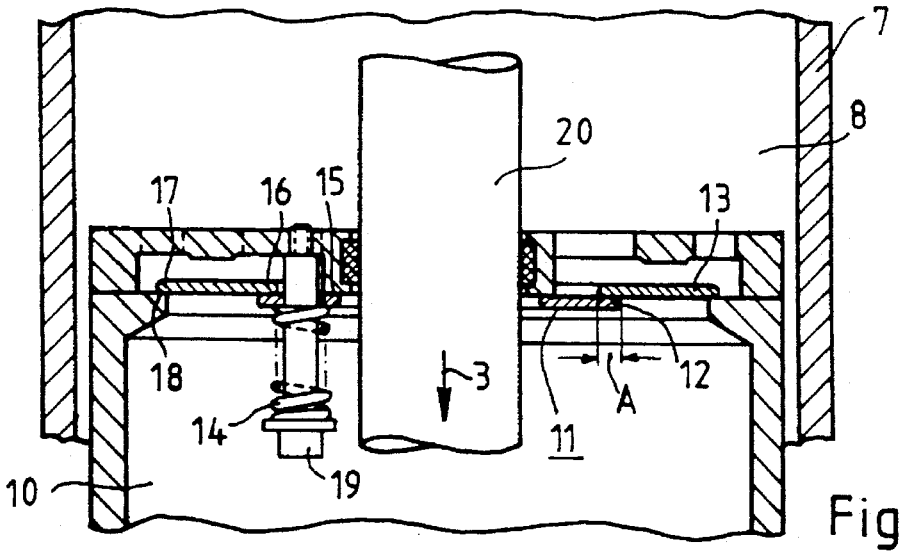
FIG. 2 shows an enlargement of a central portion of the high-tension circuit breaker of FIG. 1.

As shown in the enlarged drawing of FIG. 2, the two valve disks of the relief valve and the refill valve are combined into a single valve device 11. This valve device 11 consists of two washers 12, 13 in direct contact with one another, which have different diameters and overlap one another in the area A. Washer 12 forms the valve disk for the relief valve located between compression space 8 and low-pressure space 10. This first washer 12 has a smaller diameter than the second washer 13. On the low-pressure space 10 side it is pressed via threaded springs 14, evenly distributed over the circumference, against a fixed-position stop 15 acting as a valve seat, and is raised at a pre-defined overpressure in compression space 8 from valve seat 15. The other washer 13 has a larger diameter and is designed as a flap valve. Its opening edge 16 is in tight contact with first washer 12 and its outer edge 17 is in tight contact with a fixed-position stop 18 acting as a valve seat. When compression device 7 moves in the switch-on direction, i.e., against the direction of arrow 3, the passage section between compressor space 8 and low-pressure space 10 is uncovered for refilling the compression space.

Springs 14 are prestressed by screws 19; the spring loading of first washer 12 can be made adjustable by turning screw 19. As shown in FIG. 2, switching rods 20, which traverse compression space 8 and low-pressure space 10, and move compression device 7 are surrounded by washers 12, 13.

When one of the two washers 12, 13 is raised from its seat either by an overpressure in compression space 8 or when compression space 8 is being replenished, two paths are available for the quenching gas flow: radially inside or outside past the respective washer 12 or 13. Thus a larger flow section, matching the requirements, can be achieved for the quenching gas in either direction.

What is claimed is:

1. A high-tension circuit breaker with a separating gap and having self-generated quenching gas flow comprising:

a compression device for blow-out of electric arcs, the compression device including:

a compression space delimited by an inner wall of the compression device and by a piston;

a pressure chamber heatable by the arc energy, adjacent to the separating gap and connected to said compression space of the compression device;

a piston for insertion into an open end of the compression device, the piston including:

a low-pressure space delimited by an inner wall of the piston; and a valve device located on the piston, between the compression space and the low-pressure space, the valve device comprising first and second concentric washers in contact with one another, the second washer having an outer diameter greater than an outer diameter of the first washer and an inner diameter greater than an inner diameter of the first washer and smaller than an outer diameter of the first washer, wherein the valve device acts as a refill valve by allowing the compression space to be refilled with gas from the low-pressure space and as a relief valve by allowing gas under pressure to pass from the compression space to the low-pressure space.

2. The high-tension circuit breaker of claim 1, wherein the first washer is pressed, by a spring, against a concentric, inner valve seat on the piston and is raised from the valve seat upon occurrence of a predefined pressure in the compression space.

3. The high-tension circuit breaker of claim 2, wherein an inner opening edge of the second washer is in tight contact with the first washer and wherein an outer edge of the second washer is in tight contact with a concentric, outer valve seat on the piston, and when the compression device moves in a switch-on direction, an opening in the piston between the compression space and the low-pressure space is uncovered for refilling the compression space.

4. The high-tension circuit breaker of claim 3, wherein a bias force applied by the spring on the first washer is adjustable.

5. The high-tension circuit breaker of claim 4, wherein the compression device includes a switching rod that traverses the compression space, the low-pressure space and the piston, and which passes through the first and second washers, the switching rod being used to move the compression device relative to the piston.

6. The high-tension circuit breaker of claim 3, wherein the compression device includes a switching rod that traverses the compression space, the low-pressure space and the piston, and which passes through the first and second washers, the switching rod being used to move the compression device relative to the piston.

7. The high tension circuit breaker of claim 2, wherein a bias force applied by the spring on the first washer is adjustable.

8. The high-tension circuit breaker of claim 7, wherein the compression device includes a switching rod that traverses the compression space, the low-pressure space and the piston, and which passes through the first and second washers, the switching rod being used to move the compression device relative to the piston.

9. The high-tension circuit breaker of claim 2, wherein the compression device includes a switching rod that traverses the compression space, the low-pressure space and the piston, and which passes through the first and second washers, the switching rod being used to move the compression device relative to the piston.

10. The high-tension circuit breaker of claim 1, wherein the compression device includes a switching rod that traverses the compression space, the low-pressure space and the piston, and which passes through the first and second washers, the switching rod being used to move the compression device relative to the piston.

* * * * *